United States Patent [19]

Kinnunen

[11] Patent Number: 4,827,820

[45] Date of Patent: May 9, 1989

[54] PAPER WEB CUT-OFF DEVICE

[75] Inventor: Jorma Kinnunen, Järvenpää, Finland

[73] Assignee: Oy Wartsila AB, Finland

[21] Appl. No.: 17,700

[22] Filed: Feb. 24, 1987

[30] Foreign Application Priority Data

Feb. 24, 1986 [FI] Finland ..... 860797

[51] Int. Cl.[4] ..... B26D 5/12

[52] U.S. Cl. ..... 83/587; 83/223; 83/542; 83/564; 83/584; 83/590; 83/605; 83/610; 83/649; 83/752; 83/769

[58] Field of Search ..... 83/586, 587, 590, 563, 83/564, 610, 649, 605, 584, 542, 639, 752, 769, 773, 223, 582; 242/56 R

[56] References Cited

U.S. PATENT DOCUMENTS

| | | | |
|---|---|---|---|
| 3,474,696 | 10/1969 | Morse et al. | 83/587 X |
| 3,731,576 | 5/1973 | Smilgys et al. | 83/587 |
| 3,837,250 | 9/1974 | Lumn | 83/424 |
| 4,131,044 | 12/1978 | Cassia | 83/205 |
| 4,277,996 | 7/1981 | Spengler | 83/171 |

*Primary Examiner*—Douglas D. Watts
*Assistant Examiner*—Eugenia A. Jones
*Attorney, Agent, or Firm*—Steinberg & Raskin

[57] ABSTRACT

A paper web cut-off device, comprising a frame and a blade member mounted on the frame. The blade member is disposed to execute cutting of the paper web, with an actuator being provided for producing, on the blade member, the force required for cutting the paper web. The actuator for producing the required force for cutting of the paper web, is a spring member in which cutting energy is stored. At least one cocking or loading member is provided, which is disposed to cock or load the spring member.

32 Claims, 2 Drawing Sheets

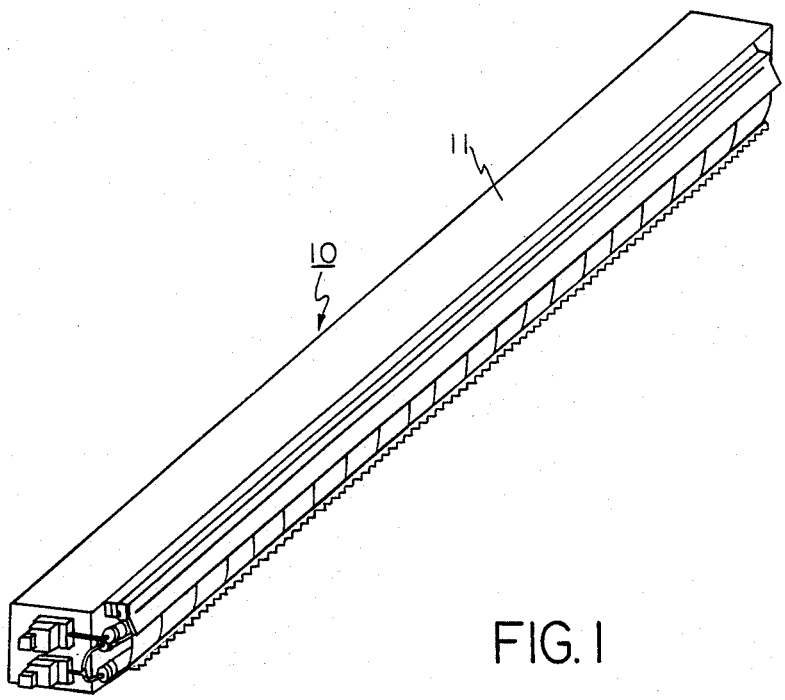
FIG. 1
FIG. 2a
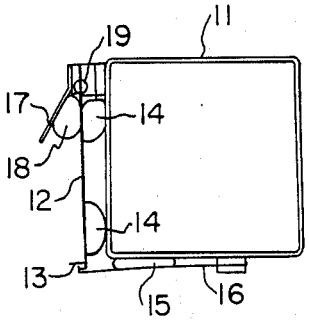
FIG. 2b
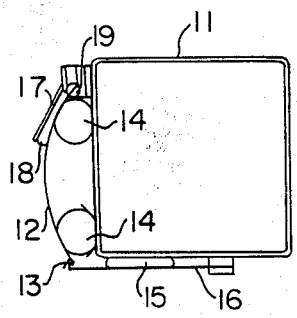
FIG. 2c
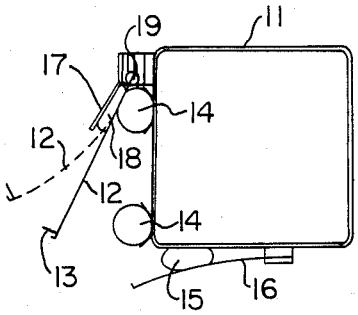

PAPER WEB CUT-OFF DEVICE

BACKGROUND OF THE INVENTION

The present invention is directed to a paper web cut-off device comprising a frame part and blade means mounted on the frame part, the blade means being disposed to accomplish cross-cutting of the paper web, in addition to actuating means for producing, on the blade means, the force required in the paper web cutting operation.

In paper web handling apparatus, e.g. unreelers, the speed of the paper web is relatively high, i.e., on the order of 1000–2500 m/min. The width of the paper web is, as a rule, on the order of 4–8 m. It is necessary to cut off the paper web for splicing on the unreelers.

Paper web cut-off devices known in the art are of such design that a plurality of compressed air cylinders situated at intervals have been arranged to act on the cutting blade of the cut-off device. After cutting, the compressed air cylinders return the cutting blade to its original position. However, with this design of the prior art, high enough speed of the cutting blade cannot be achieved, and an excessive delay is therefore incurred in the cut-off operation, with the result of cutting-off at an incorrect point. In other words, the cut-off is inaccurate regarding location. The slow motion of the cutting blade also results in improper cutting of the paper web.

Presently, a paper web cut-off device is commonly required to have an accuracy of about 0.3 m. This means that the delay counted from the cut-off command, must be such that the cut-off error is within the specified limit of accuracy, 0.3 m. In the design of the prior art in which a plurality of compressed air cylinders spaced from one anotheer is used, the time lag is on the order of 0.25 sec. With present-day web speeds, this corresponds to a distance of about 5 m. on the web. This implies that, if a 10% error is allowed in the cutting, an accuracy of the cut-off device of the prior art is no better than on the order of 0.5 m.

SUMMARY OF THE INVENTION

Accordingly, it is an object of the present invention to provide improvement over paper web cut-off apparatus known in the art.

It is a more specific object of the present invention to provide a paper web cut-off device in which movement of the blade unit of the cut-off device on a received cutting command can be made quick enough so that a time lag will not cause excessive inaccuracy of the cut-off point.

These and other objects are attained by the present invention which is directed to paper web cut-off device principally characterized by the actuating means serving to generate, on the blade unit, the force required for cutting of the paper web, being constituted by spring means in which cutting energy is stored, and the cut-off device being provided with cocking or loading means arranged to cock or load the spring means.

It is understood that in the paper web cut-off device of the present invention, cutting energy derived from compressed air is stored in spring means which may advantageously be constituted by a bendable plate spring. The energy stored in this spring means can be very quickly released by releasing a retainer device, whereby movement of the cutting blade will be extremely fast. Due to this insight, in the paper web cut-off device of the present invention the time lag from cut-off command is no more than on the order of 0.1 sec., or even less. With present-day paper web speeds, e.g. 1,200 m/min, this corresponds to a distance along the web which is equal to or smaller than 2 m. If a 10% error is allowed, in cutting the paper web, then the accuracy of the paper web cut-off device of the present invention will be equal to or better than 0.2 m. Thus, the cut-off device of the present invention meets the accuracy criteria which is presently generally stipulated, i.e., 0.3 m.

BRIEF DESCRIPTION OF THE DRAWINGS

The present invention will now be described in greater detail with reference to certain preferred embodiments depicted in the accompanying drawings, to which the present invention is not intended to be exclusively confined.

FIG. 1 is an axonometric projection of an embodiment of the cut-off device of the present invention;

FIG. 2*a* is a cross-sectional illustration of the cut-off device of FIG. 1 in a position in which spring means therein are retained back by a retaining device, with the spring means not being cocked;

FIG. 2*b* is an illustration similar to FIG. 2*a* in a position in which the spring means are cocked or loaded;

FIG. 2*c* is an illustration similar to FIG. 2*a* in the position in which the retainer device or retainer means has released the spring means, and, by this effect, has released the cutting blade.

DESCRIPTION OF THE PREFERRED EMBODIMENTS

Figure 3:
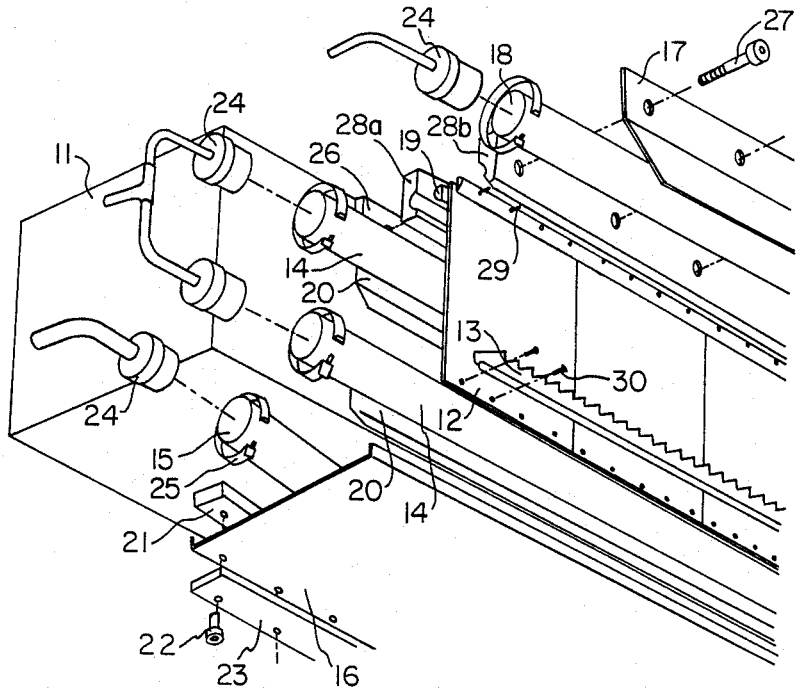
FIG. 3 is an axonometric projection of preferred assembly of the cut-off device of FIG. 1.

In the embodiment of FIGS. 1 and 2*a*–2*c*, the paper web cut-off device of the present invention is generally indicated by reference 10. The cut-off device 10 comprises a frame part 11, spring means 12, a cutting blade 13, cocking or loading means 14 for cocking or loading the spring means 12, releasing means 15 for releasing the cutting blade 13, retainer means 16 for retaining the cutter blade 13 and return means 18 for returning the cutting blade 13, after the paper web has been cut, to its original position. A limiter for the cutting blade 13 is indicated by reference 17, with the swivelling hinge therefor being indicated by reference 19.

The frame part 11 is advantageously a frame being made, e.g., of square tubular section material with sufficient cross-sectional dimensions in view of the length of the beam. The wall thickness of the beam must be sufficient enough so that the wall will not bend too greatly when the spring means 12 is being cocked or loaded. The cutting blade 13 is advantageously a single coherent part made, e.g., of sheet metal and having a width substantially equal to the width of the entire web.

The blade means 13 have an edge for retention by the retainer means 16. Springs of the spring means 12 are advantageously made of hardened annealed spring steel strip material. The springs of the spring means 12 are punched with holes required for fixing screws and rivets. The width of the springs of the spring means 12 is equal to the width of the steel strip supply, with the margins of the strip being rounded, while the surface quality thereof must be good in view of fatigue strength. It is also possible to form the spring means 12 of one piece of a wide strip material, in which case, however, the rolling direction of the steel strip will be transverse in relation to bending stresses, resulting in lower strength of the steel.

The cocking or loading means 14, the releasing means 15, and the return means 18 are advantageously constituted by fabric-reinforced fire hoses expandable by introduction of compressed fluid, e.g. compressed air, thereinto. The bursting pressures of the hoses 14, 15, 18 are on the order of 3.5 to 5 MPa, depending on the diameter thereof.

FIG. 3 illustrates advantageous assembly of the paper web cut-off device for the present invention. Supports 20 for the cocking or loading hoses 14 prevent lateral displacement of the cocking or loading hoses 14 when the spring means 12 is being cocked or loaded. The cocking or loading hoses 14 are advantageously cemented onto the supports 20 over the entire length thereof.

Retainer means 16 are advantageously constituted as a retainer spring, which is also preferably formed as a single piece of spring steel strip material. An attachement rail 21 is welded to the frame beam 11, with the retainer spring 16 being mounted onto the attachement rail 21 using appropriate fixing elements, such as, e.g. fixing screws 22 with the aid of supporting plates 23. End plugs 24 are attached to the cocking or loading hoses 14, the releasing hose 15 and the return hose 18, by means of clamps 25. Air hoses extend to valves from the end plugs 24. For faster action, air is supplied through both ends of the releasing hose 15.

An attachment 26 for the hinge 19 is welded onto the frame beam 11, and is provided with holes and threads for fixing elements such as fixing screws 27. Halves **28*a* and 28*b* of the hinge 19 are preferably formed of rectangular bar material. There are machined grooves running the entire length in the rectangular bars, so that a cylindrical channel remains between the two bodies. Especially high shaping accuracy is not required of these grooves, so that the grooves may therefore be produced, for example, with a profile cutter. The rod halves of the hinge 19 are advantageously made of solid drawn axle steel, by either splitting a rod of such material, or by milling two rods. Holes and threads are machine in the halves clamped together, for the fixing members, e.g. for hex socket screws 29. The limiter plate 17 for the cutting blade 13 is made of sheet metal by angulation, with the return hose 18 being cemented thereon over the entire length thereof. The cutting blade 13 is attached to the spring of the spring means 12 with rivets 30**.

The preceding description of the present invention is merely exemplary, and is not intended to limit the scope thereof in any way, with numerous modifications being contemplated within the scope of the inventive concept set forth above.

What is claimed is:

1. Paper web cut-off device for cutting a paper web, comprising a frame, blade means fitted in said frame and arranged to carry out the cutting of the paper web, spring means for producing, on said blade means, force required for cutting the paper web, and said device additionally comprising means for cocking said spring means, whereby cutting energy is generated, which is stored in said spring means, retaining means for retaining said blade means in an initial position, releasing means for releasing said blade means from said retaining means, and return means for returning said released blade means to the initial position.

2. The device of claim 1, wherein said cocking means comprise at least one hose expandable by introduction of compressed fluid thereinto.

3. The device of claim 2, additionally comprising at least one support mounted on said frame for said at least one hose and mounted to prevent lateral displacement thereof when said spring means are being cocked.

4. The device of claim 3, wherein said hose is affixed to said support substantially over the entire length thereof.

5. The device of claim 1, wherein said releasing means comprise a hose expandable by introduction of compressed fluid thereinto.

6. The device of claim 5, wherein said hose comprises openings at opposite ends for introduction of the compressed fluid thereinto.

7. The device of claim 1, wherein said retaining means are constituted by a retainer spring.

8. The device of claim 4, wherein said retainer spring is formed of a single piece of spring steel strip material.

9. The device of claim 4, additionally comprising an attachment rail mounted on said frame and upon which said retainer spring is mounted.

10. The device of claim 1, wherein said return means comprise a hose expandable by introduction of compressed fluid thereinto.

11. The device of claim 1, additionally comprising a limit for limiting movement of said blade means away from the initial position.

12. The device of claim 11 wherein said limit is a plate obliquely mounted upon said frame.

13. The device of claim 11 wherein said limit plate is constituted by angular sheet metal.

14. The device of claim 13 wherein said frame comprises a substantially square cross-section, with hinge means being mounted at one surface thereof, and additionally comprising a retainer spring mounted at a substantially perpendicular surface thereof and having a catch at an end thereof for retaining said spring means and blade means in position, and a release hose expandable by introduction of compressed fluid thereinto and mounted between said perpendicular surface and retainer spring.

15. The device of claim 1, wherein said blade means comprise a coherent blade having a width substantially equal to a width of the paper web.

16. The device of claim 15, wherein said blade means additionally comprise an edge on the cutting blade for retention by said retaining means.

17. The device of claim 1, wherein said spring means comprise a plurality of springs made of hardened annealed spring steel strip material.

18. The device of claim 1, wherein said blade means are directly mounted on said spring means.

19. The device of claim 18, wherein said blade means are mounted substantially at an end of said spring means.

20. The device of claim 19, wherein said spring means are mounted upon said frame at an end opposite said blade means and biased for substantially upward movement.

21. The device of claim 18, wherein said blade means are only mounted on said spring means.

22. The device of claim 18, wherein said blade means are attached to said spring means by rivets.

23. The device of claim 1, wherein said spring means are constituted by a substantially flat spring.

24. The device of claim 23, wherein said spring is made of hardened annealed spring steel strip material.

25. The device of claim 23, wherein said spring is made from a single piece of a wide strip material.

26. The device of claim 18, additionally comprising hinge means at which said spring means are mounted on said frame, for swivelling said spring means.

27. The device of claim 26, wherein said cocking means comprise a hose expandable by introduction of compressed fluid therein and mounted between said frame and spring means and underneath said hinge means.

28. The device of claim 27, additionally comprising a limit plate obliquely mounted upon said frame at said hinge means.

29. The device of claim 28, additionally comprising a return hose expandable by introduction of compressed fluid thereinto and mounted between said limit plate and spring means.

30. The device of claim 27, wherein said cocking means comprise a pair of separate, substantially parallel hoses mounted on said frame.

31. The device of claim 1, wherein said blade means comprise a single coherent blade made of sheet metal and having a width substantially equal to a width of the entire web.

32. Paper web cut-off device for cutting a paper web, comprising a frame blade means fitted in said frame and arranged to carry out the cutting of the paper web, spring means for producing, on said blade means, force required for cutting the paper web, and said device additionally comprising means for cocking said spring means, whereby cutting energy is generated which is stored in said spring means, wherein said blade means are directly mounted on said spring means, and said cocking means comprise a pair of separate, substantially parallel hoses mounted on said frame and expandable by introduction of compressed fluid therein.

* * * * *